US005597327A

United States Patent [19]

Agro

[11] Patent Number: 5,597,327

[45] Date of Patent: Jan. 28, 1997

[54] SPRING TERMINAL AND METHOD FOR MAKING A SPRING TERMINAL

[75] Inventor: James V. Agro, Geneva, Ill.

[73] Assignee: Cooper Industries, Inc., Houston, Tex.

[21] Appl. No.: 443,451

[22] Filed: May 18, 1995

[51] Int. Cl.[6] ..... H01R 17/00

[52] U.S. Cl. ..... 439/617; 439/857

[58] Field of Search ..... 439/857, 856, 439/611, 617, 618

[56] References Cited

U.S. PATENT DOCUMENTS

| | | | |
|---|---|---|---|
| 1,622,631 | 3/1927 | Fahnestock | 439/857 |
| 1,702,451 | 2/1929 | Phillippi | 439/857 |
| 3,076,953 | 2/1963 | Sloop | 439/857 |
| 4,460,239 | 7/1984 | Inoue | 439/857 |
| 4,471,157 | 9/1984 | Peters et al. | 439/611 |
| 5,049,511 | 9/1991 | Yu | 439/856 |
| 5,064,379 | 11/1991 | Ryll et al. | 439/857 |

*Primary Examiner*—Stephen P. Garbe

*Attorney, Agent, or Firm*—Burns, Doane, Swecker & Mathis, L.L.P.

[57] ABSTRACT

In a spring terminal, a central web and a left and a right spring assembly are provided. Each spring assembly is substantially U-shaped and includes first and second legs interconnected by a bight. A first leg of each spring assembly is attached to the central web and extends therefrom toward a respective bight. A second leg of each spring assembly extends toward the central web from a respective bight. Both second legs of the spring assemblies are disposed between the first legs and define a socket together with the central web. The second legs are flexible with respect to the central web in directions toward and away from each other. A socket assembly including spring terminals and a method of making a spring terminal are also disclosed.

11 Claims, 2 Drawing Sheets

SPRING TERMINAL AND METHOD FOR MAKING A SPRING TERMINAL

FIELD OF THE INVENTION

The present invention relates to electrical contacts and, more particularly, to spring terminals for use in quick connect electrical devices.

BACKGROUND AND SUMMARY

It is well-known to provide sockets having electrical contacts in electrical devices such as lighting fixtures having light bulbs. Certain well-known, older styles of light bulb sockets are threaded for receiving threaded bulbs. Certain track lighting sockets, such as those used with "PAR-36" style bulbs, include electrical wires having, at ends thereof, fork terminals that are attached to screws on the back of the bulb. Attachment of the fork terminals to the bulb is time-consuming chore that must often be performed under adverse conditions, such as while standing on a ladder.

More modern sockets, such as those used with track lighting, are of the so-called quick connect type and permit installation and removal of light bulbs, such as PAR-36 bulbs, upon forcing a male terminal member of the bulb between a pair of spring arrangements, or spring terminals, that function both as electrical contacts and as means for holding the bulb in position. The spring terminals are generally mounted inside of a contact cover into which wires are passed and connected to the spring terminals.

The prior art spring terminals typically comprise a first, substantially U-shaped, highly resilient member, usually formed from a single piece of conductive metallic material. The male terminal member of the bulb is forced between the legs of the first member, the legs being connected to each other by a common web and acting as leaf springs. The legs of the first member are typically provided with corrugations extending laterally across the width of the first member to facilitate retaining the male terminal member in the space defined by the legs. A strip-like portion of the male terminal member is received in the corrugations and contacts the legs to form an electrical connection. There is, therefore, little surface area contact between the legs and the male terminal member.

The leaf spring legs of the first member, standing alone, tend to only weakly clamp the male terminal member between them. Further, over time, the leaf spring legs tend to lose tension and function even less well as clamps. The poor clamping of provided by the legs tends to result in poor electrical contact with the male terminal member of the bulb, particularly in view of the limited amount of surface area contact between the legs and the male terminal member, which may result in arcing and solder melt and premature lamp failure.

Spring backers, which are usually in the form of substantially rigid U-shaped members, are generally provided to offer additional strength to the legs of the first member. The first member is disposed between legs of the spring backers, the legs of the spring backers being shorter than the legs of the first member to permit bending of the legs of the first member for installing or removing a bulb. However, while spring backers improve the operation of the first member, the legs of the first member nonetheless tend to lose tension over time, provide poor clamping power, and provide poor electrical contact. Moreover, the spring backers comprise yet another component of a socket assembly and increase assembly difficulty and cost.

Prior art spring terminals are typically connected to wires by means of a tubular prong that extends off of the web connecting the legs of the first member. Stripped ends of the wires are received in the tubular prong and are crimped or soldered therein. The prongs are typically pointed in opposite directions, facing away from each other, to minimize the possibility of shorting. This arrangement tends to require the wires to be bent significantly over relatively short distances, and requires large amounts of wire inside the relatively small contact cover.

It is desirable to provide a socket having quick connect spring terminals that provide good clamping and electrical contact properties. It is further desirable to provide a socket having quick connect spring terminals that require few parts, are simple to assemble, and are low in cost.

In accordance with one aspect of the present invention, a spring terminal formed of electrically conductive material is provided. The spring terminal includes a central web, and a left and a right spring assembly. Each spring assembly is substantially U-shaped and includes first and second legs interconnected by a bight. A first leg of each spring assembly is attached to the central web and extends therefrom toward a respective bight. A second leg of each spring assembly extends toward the central web from a respective bight. Both second legs of the spring assemblies are disposed between the first legs and define a socket together with the central web. The second legs are flexible with respect to the central web in directions toward and away from each other.

In accordance with another aspect of the present invention, a method of making a spring terminal is provided. According to the method, a flat sheet of conductive material is provided. A left and a right end of the conductive material are bent relative to a central region such that the left and right end are substantially perpendicular to the central region. The left and right end are also bent such that edges of the left and right end are disposed proximate the central region and define, with the central region, a socket.

In accordance with yet another aspect of the present invention, a socket assembly is provided. The socket assembly includes a pair of spring terminals formed of an electrically conductive material. Each spring terminal includes a central web, and a left and a right spring assembly. Each spring assembly is substantially U-shaped and includes first and second legs interconnected by a bight. A first leg of each spring assembly is attached to the central web and extends therefrom toward a respective bight. A second leg of each spring assembly extends toward the central web from a respective bight. Both second legs of the spring assemblies are disposed between the first legs and define a socket together with the central web. The second legs are flexible with respect to the central web in directions toward and away from each other. The socket assembly further includes a contact cover. The pair of spring terminals are mounted inside of the contact cover such that the sockets of the pair of spring terminals are aligned with each other.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
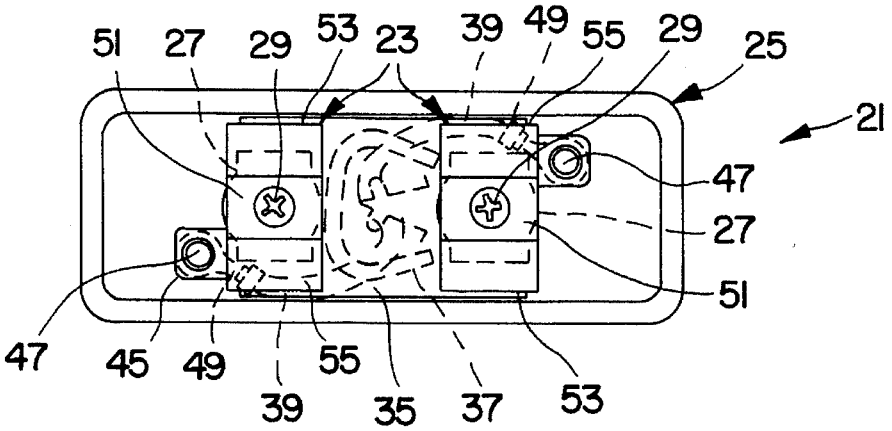
FIG. 1 is a top plan view of a socket assembly according to an embodiment of the present invention.

A quick connect socket assembly 21 according to an embodiment of the present invention is seen with reference to FIG. 1. The socket assembly 21 includes a pair of contacts or spring terminals 23, 23 that are aligned for receiving male terminal members of an electrical device, such as contacts of a PAR-36 bulb. The spring terminals 23, 23 are mounted in a contact cover 25 that is preferably formed of a rigid insulating material, such as plastic.

Figure 2:
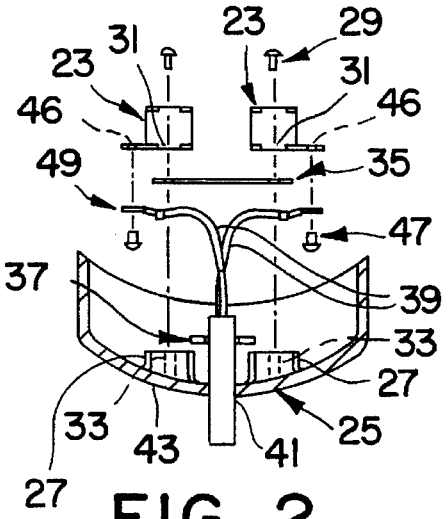
FIG. 2 is a side, partially cross-sectional, exploded view of a socket assembly according to an embodiment of the present invention.

As seen in FIG. 2, the contact cover 25 is preferably shaped to conform to the contour of the rear of the bulb that is to be used with the socket assembly and has two posts 27, 27 for mounting the spring terminals 23, 23 thereon, such as by screws 29, 29 that extend through holes 31, 31 in the spring terminals and are received in threaded holes 33, 33 in the posts. The threaded holes may be provided by molding a metallic, threaded insert in the posts 27, 27 to provide stronger threads than might ordinarily be provided with plastic. An insulating sheet of barrier material 35, preferably a NOMEX barrier, available from Active Industries, Inc., Willowbrook, Ill., is preferably provided between the spring terminals 23, 23 and the posts 27, 27, and a strain relief device 37, such as a tightly fitting collar, is provided beneath the barrier material and around the sleeving of a wire, preferably including at least two wires 39, 39, that is introduced through a hole 41 provided in a rear wall 43 of the contact cover 25 for attachment to terminal connection mounting points 45, 45 on the spring terminals 23, 23, such as by rivets 47, 47 and wire rings 49, 49. If desired or necessary, the wires 39, 39 may be attached directly to the spring terminals 23, 23, such as by soldering or other suitable techniques. The collar 37 or similar device is preferably provided around the sleeving of the wire to prevent the wires from being pulled out of the contact cover 25. The terminal connection mounting points 45, 45 are preferably provided with holes 46, 46 for receiving the rivets.

The terminal connection mounting points 45, 45 are preferably arranged in the contact cover 25 such that they are on opposite sides of the spring terminals 23, 23, facing away from each other. As can be seen in FIG. 1, the wires 39, 39 are run symmetrically from the hole 35 to their respective terminal connection mounting points 41, 41, need only run a short distance inside of the contact cover, and need not be greatly twisted to accomplish the connection between the spring terminals 23, 23 and the wires.

Figure 3:
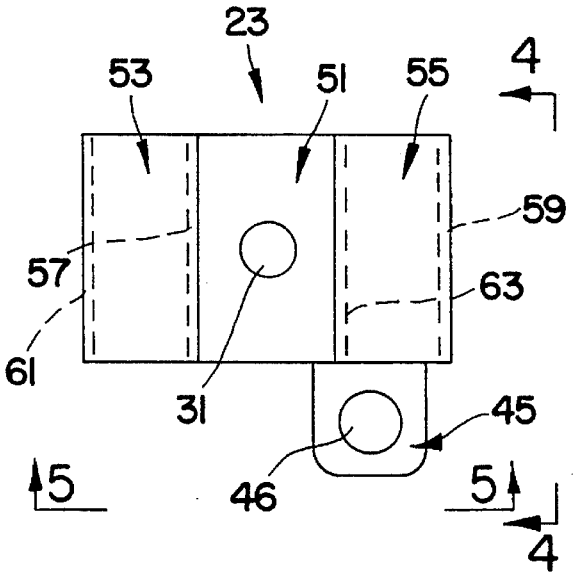
FIG. 3 is a top plan view of a spring terminal according to an embodiment of the present invention.
Figure 4:
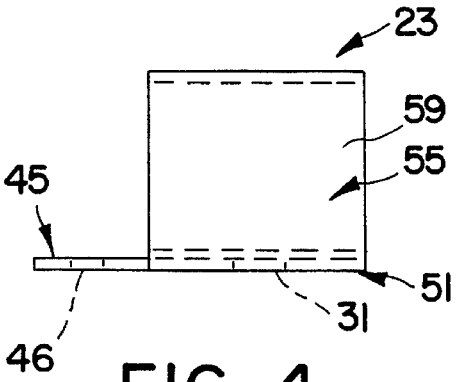
FIG. 4 is a side view of the spring terminal of FIG. 3 taken at section 4—4 of FIG. 3.
Figure 5:
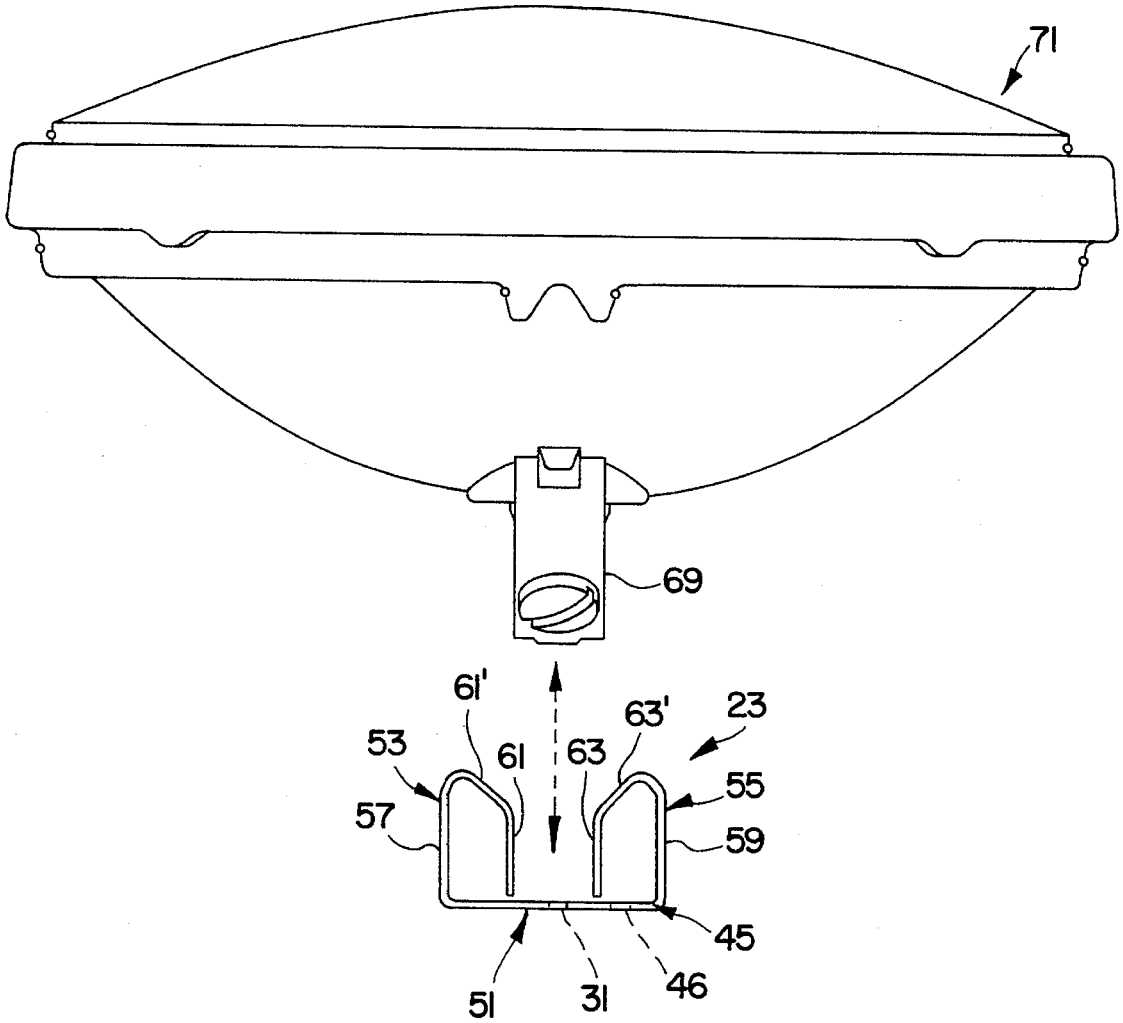
FIG. 5 is an end view of a spring terminal according to the present invention showing its cooperation with a conventional electrical device.

Each spring terminal 23 is preferably identical to the other spring terminal. As seen in FIGS. 3–5, each spring terminal 23 includes a central web 51 connecting a left and a right spring assembly 53, 55. The hole 31 is preferably provided in a center of the central web 51. The left and right spring assemblies 53, 55 and the central web 51 are preferably all formed from a single piece of material, preferably a 22 gage, nickel plated, #510 half hard phosphor bronze material.

The left and right spring assemblies 53, 55 each have first legs 57, 59, respectively, attached to the central web 51, preferably at opposite, outer ends thereof, and second legs 61, 63, respectively, disposed between the first legs, and connected by a bight 65, 67, respectively. The first and second legs 57, 59 and 61, 63 are preferably both substantially perpendicular to the central web 51. The second legs 61, 63 and the central web 51 define a U-shaped socket in which a male terminal member 69 of a lamp 71 (FIG. 5) is received.

The first leg 57, 59 of each spring assembly 53, 55 is attached to the central web 51 and extends therefrom toward a respective bight 65, 67. A second leg 61, 63 of each spring assembly 53, 55, is disposed between the first legs 57, 59 and extends toward the central web 51 from a respective bight 65, 67. The second legs 61, 63 are flexible with respect to the central web 51 in directions toward and away from one another.

As seen in FIGS. 3 and 4, the terminal connection mounting points 45 are preferably formed as outwardly extending portions of the central web 51, as part of the single piece from which the central web and the left and right spring assemblies are formed. The terminal connecting mounting point 45 is disposed at a distance from the socket defined by the second legs 61, 63 and the central web 51.

As seen in FIG. 5, the upper ends 61', 63' of the second legs 61, 63 are preferably sloped such that an upper region of the socket defined by the second legs and the central web 51 is substantially V-shaped and larger than a lower region of the socket. By providing the sloped upper ends 61', 63' of the second legs 61, 63, insertion of the male terminal member 69 of the lamp 71 into the socket is facilitated. FIG. 5 shows a PAR-36 bulb of the type available from General Electric Lighting, Cleveland, Ohio. Other manufacturers make similar style lamps or bulbs.

The second legs 61, 63 are spaced from the first legs 57, 59. When the male terminal member 69 of the lamp 71 is inserted into the socket defined by the second legs 61, 63 and the central web 51, the second legs are moved outwardly to permit insertion of the male terminal member as a result of deflection of one or both of the first legs 57, 59 relative to the central web and the second legs relative to the first legs. While not wishing to be bound by theory, it is believed that superior clamping and electrical connection properties of the spring terminal 23 according to the present invention, compared to prior art spring terminals as described above, are at least in part attributable to absorption of loads, during insertion of the male terminal member 69 into the socket defined by the second legs 61, 63 and the central web 51, by both the first and the second legs. The spring terminals 23, 23, in addition, tend to serve as heat sinks to remove heat from the male terminal member 69 of the lamp 71. Also, due to improved contact with the male terminal member 69, there is less likelihood of solder melt from arcing or high temperatures and the possibility of fusing of the male terminal member 69 to the spring terminals is minimized.

The spring terminals 23, 23 are preferably made by bending a left and a right end of a flat sheet of conductive material relative to a central region such that the left and right end are substantially perpendicular to the central region, the central region defining the central web 51. The left and right end are further bent such that edges of the left and right end are disposed proximate the central region and define, with the central region, a socket. The left and right end are thus bent to define the left and right spring assemblies 53, 55 that are substantially U-shaped and have first and second legs 57, 59 and 61, 63 spaced at a distance from each other. The left and right end are preferably bent such that an upper end 61', 63' of each of the second legs 61, 63 is sloped such that an upper region of the socket is substantially V-shaped and larger than a lower region of the socket.

Since the spring terminal 23 according to the present invention may be made from a single piece of material by a relatively simple bending method as described above, the spring terminal may be produced at low cost. In addition, assembly of a socket assembly 21 utilizing the spring terminal 23 according to the present invention is facilitated as the spring terminal is preferably a single piece and wiring connections to the spring terminal are simple and require little wasted wire lengths, reducing costs of the socket assembly. The spring terminal 23 firmly clamps male terminal members of electrical devices such as light bulbs and minimizes risks of accidental disconnections or poor connections which can result in arcing and damage to the socket and electrical device. In addition, as a result of the structure of the spring terminal 23 and the firm clamping of male terminal members provided by the spring terminal, the spring terminal facilitates providing an increased contact area between the spring terminal and the male terminal member to further minimize the possibility of arcing and damage.

The spring terminal 23 permits instant installation and removal of all varieties of lamps of the type using contacts such as those used with PAR-36 style bulbs. As noted above, PAR-36 bulbs were originally designed to be used with fork terminals screwed to the contacts. Since there is no need for perfect alignment of the contacts if they are intended to be attached to fork terminals, manufacturing tolerances for PAR-36 bulbs tend to be great and, accordingly, the contacts are often skewed or otherwise incorrectly aligned. The poorly aligned contacts make it difficult to use conventional spring terminals which, because of the use of rigid spring backers, require much closer tolerances. However, since the spring terminal according to the present invention avoids the use of rigid spring backers, and both the left and right spring assemblies 53, 55 are flexible, the spring terminal facilitates the use of bulbs having poorly aligned contacts.

While this invention has been illustrated and described in accordance with a preferred embodiment, it is recognized that variations and changes may be made therein without departing from the invention as set forth in the claims.

What is claimed is:

1. A socket assembly, comprising:

a pair of spring terminals formed of an electrically conductive material, each spring terminal including a central web, and a left and a right spring assembly, each spring assembly being substantially U-shaped and including first and second legs interconnected by a bight, a first leg of each spring assembly being attached to the central web and extending therefrom toward a respective bight, a second leg of each spring assembly extending toward the central web from a respective bight, with both second legs of the spring assemblies being disposed between the first legs and defining a socket together with the central web, the second legs being flexible with respect to the central web in directions toward and away from each other;

a contact cover, the pair of spring terminals being mounted inside of the contact cover such that the sockets of the pair of spring terminals are aligned with each other.

2. The socket assembly as set forth in claim 1, wherein, for each spring terminal, the central web and the left and right spring assemblies are formed from a single piece of material.

3. The socket assembly as set forth in claim 1, wherein each spring terminal further includes a terminal connection mounting point including a hole formed in the spring terminal for riveting a ring terminal.

4. The socket assembly as set forth in claim 3, wherein the terminal connection mounting point is disposed at a distance from the socket.

5. The socket assembly as set forth in claim 4, wherein the terminal connection mounting point is formed on a portion of the web.

6. The socket assembly as set forth in claim 5, wherein the central web and the left and right spring assemblies are formed from a single piece of material.

7. The socket assembly as set forth in claim 1, wherein, for each spring terminal, an upper end of each of the second legs is sloped such that an upper region of the socket is substantially V-shaped and larger than a lower region of the socket.

8. A method of making a socket assembly, comprising the steps of:

forming a pair of spring terminals by, for each spring terminal, providing a flat sheet of conductive material, bending a left and a right end of the conductive material relative to a central region such that the left and right end are substantially perpendicular to the central region, and bending the left and right end such that edges of the left and right end are disposed proximate the central region and define, with the central region, a socket; and mounting the pair of spring terminals inside of a contact cover such that the sockets of the pair of spring terminals are aligned with each other.

9. The method of making a socket assembly as set forth in claim 8, wherein the left and right end are each bent such that they are substantially U-shaped and have first and second legs spaced at a distance from each other.

10. The method of making a socket assembly as set forth in claim 9, wherein the left and right end are each bent such that an upper end of each of the second legs is sloped such that an upper region of the socket is substantially V-shaped and larger than a lower region of the socket.

11. The method of making a socket assembly as set forth in claim 8, comprising the further step of forming a terminal connection mounting point on the spring terminal by forming a hole in the spring terminal.

* * * * *